United States Patent [19]

Laudig et al.

[11] Patent Number: 4,772,222

[45] Date of Patent: Sep. 20, 1988

[54] COAXIAL LMC CONNECTOR

[75] Inventors: Ronald C. Laudig; Randolph E. Capp, both of Mechanicsburg; George W. Michael, Harrisburg; Donald L. Smith, Middletown, all of Pa.

[73] Assignee: AMP Incorporated, Harrisburg, Pa.

[21] Appl. No.: 109,350

[22] Filed: Oct. 15, 1987

[51] Int. Cl.[4] ..... H01R 17/18

[52] U.S. Cl. ..... 439/578; 439/874

[58] Field of Search ..... 439/466, 901, 902, 904, 439/905, 578–585, 675, 63, 874, 468, 473

[56] References Cited

U.S. PATENT DOCUMENTS

| | | | |
|---|---|---|---|
| 2,335,041 | 8/1942 | Bruno . | |
| 3,047,828 | 7/1962 | Gregson et al. . | |
| 3,836,946 | 9/1974 | Geiger | 439/580 |
| 4,047,788 | 9/1977 | Forney, Jr. et al. . | |
| 4,049,902 | 9/1977 | de Ronde . | |
| 4,096,627 | 6/1977 | Forney, Jr. et al. | 29/628 |
| 4,156,554 | 5/1979 | Aujla | 439/584 |
| 4,261,630 | 4/1981 | Knappenberger . | |
| 4,557,546 | 12/1985 | Dreyer | 439/584 |
| 4,655,534 | 4/1987 | Stursa | 439/582 |

OTHER PUBLICATIONS

Data Sheet 80-600 of AMP Incorporated, issued Mar. 1981.

*Primary Examiner*—David Pirlot

*Attorney, Agent, or Firm*—Gerald K. Kita

[57] ABSTRACT

A kit of parts, comprising; a connector shell (7) for a coaxial cable (2) having a tool receiving cavity portion (11) open toward two orthogonal directions, a contact holder (14) and a cable holder (15), and a conductive cover (51) for covering the cavity portion (11) of the shell (7), and a conductive ferrule (38) for wedge fit assembly in the cable holder (15), the cover (51) having hooks (52,52) for engaging the shell (7) and the shell (7) having cover supports (12,12) for engaging and deflecting the cover (51) to a bent position.

10 Claims, 3 Drawing Sheets

COAXIAL LMC CONNECTOR

FIELD OF THE INVENTION

The invention relates to an electrical connector for an electrical coaxial cable, and more particularly, to a connector for accommodating a soldering tool for assembly of the connector to a coaxial cable.

BACKGROUND OF THE INVENTION

U.S. Pat. No. 4,096,627 discloses a known connector for a coaxial cable wherein a port hole permits orientation and entry of crimping dies for crimping a center contact to a center conductor of a coaxial cable.

U.S. patent application Ser. No. 576,170, filed Feb. 1, 1882, discloses a known connector of right angle shape. An open cylindrical end on a cylindrical portion of the connector allows access of a crimping die for crimping an electrical contact to a center conductor of a coaxial cable.

U.S. Pat. No. 4,049,902 discloses a known connector for a coaxial cable wherein the known connector has an open cylindrical end and a slot. A cable is inserted through the slot with an outer conductor of the cable resting on an annular shoulder and an inner conductor looped and soldered around an inner conductor of another cable.

In each of the known connectors, an open portion allows access of a tool to the interior of the connector to perform an assembly operation, for example, crimping or soldering to a center conductor of a coaxial cable. Access to the interior of the connector is limited by the size of the open portion. The size of the open portion is limited by the diameter of the connector that surrounds the open portion. The known connectors when made in a small size will have open portions that are too small to permit access of a tool for performing an assembly operation. Open portions of the known connectors are covered with disc shaped covers.

SUMMARY OF THE INVENTION

An aspect of the invention resides in a connector for a coaxial cable, a conductive shell of the connector having a tool receiving cavity portion open toward two orthogonal directions, a contact holder and a cable holder extending from the cavity portion, cover engaging supports, and an elongated cover engaging the supports. Even if the overall size of the connector is relatively small, the cavity portion is open toward two orthogonal directions to provide an opening of generous size to receive a tool, for example, a tip of a soldering gun. The contact holder and the cable holder extending from the cavity portion can be constructed with relatively small diameters without causing a reduction in the size of the tool receiving cavity portion.

A further aspect of the invention resides in a connector for a coaxial cable in which the connector includes an elongated conductive cover with hooks at opposite ends of the cover, the cover covers a cavity portion of the shell, cover engaging supports engage and resiliently deflect the cover to a position bent along its length, and the hooks engage a shell of the connector and retain the cover in a bent position and in engagement against the supports. The cover is assembled on the cavity portion without requiring a tool. The bent position maintains tension on the hooks of the cover to maintain the hooks engaged on the connector, thereby to retain the cover in position on the cavity portion.

Other advantages and objects of the invention are apparent by way of example from a detailed description that follows, and from accompanying drawings.

DETAILED DESCRIPTION

Figure 1:
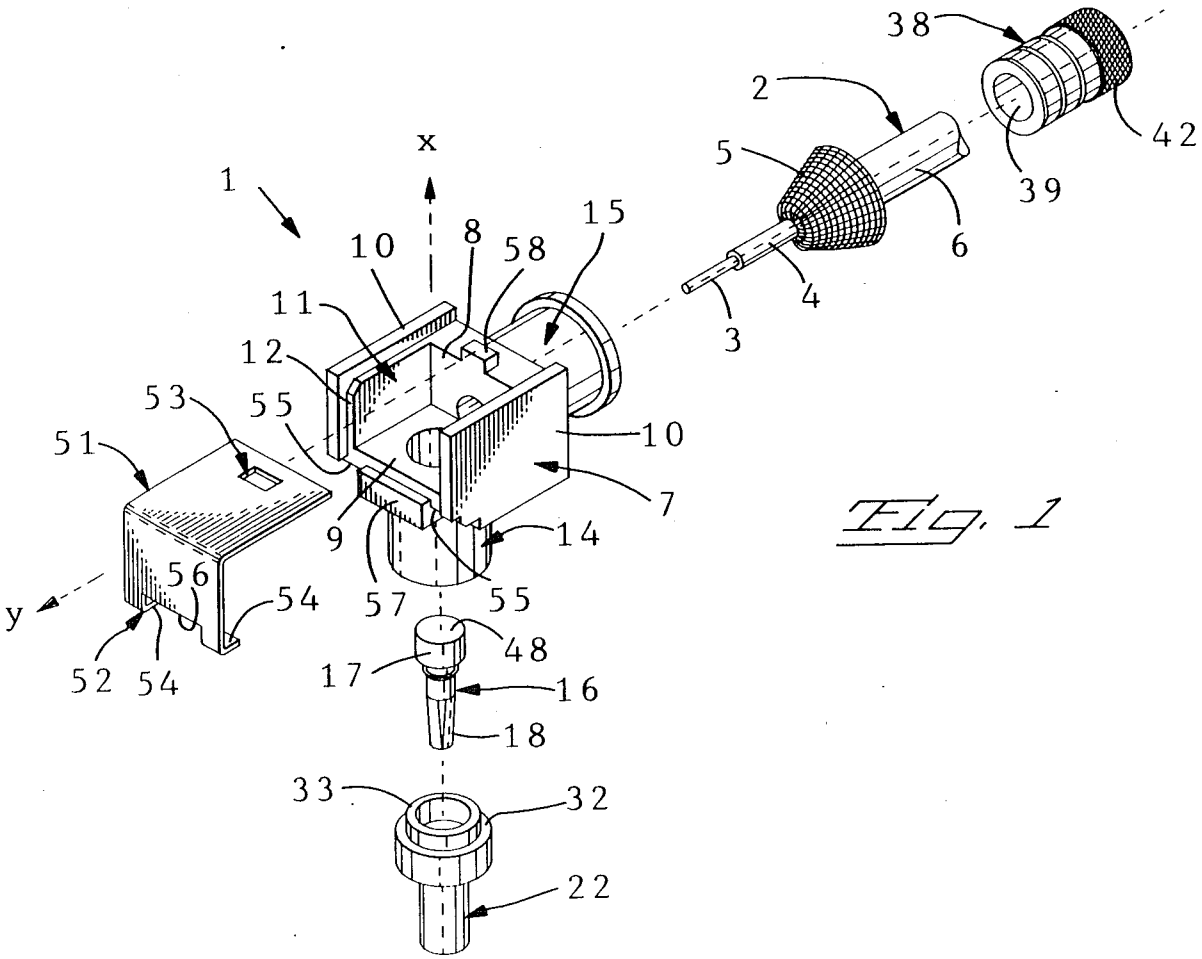
FIG. 1 is an enlarged fragmentary perspective view of an embodiment, by way of example, including a connector and a coaxial cable with parts in exploded configuration.
Figure 2:
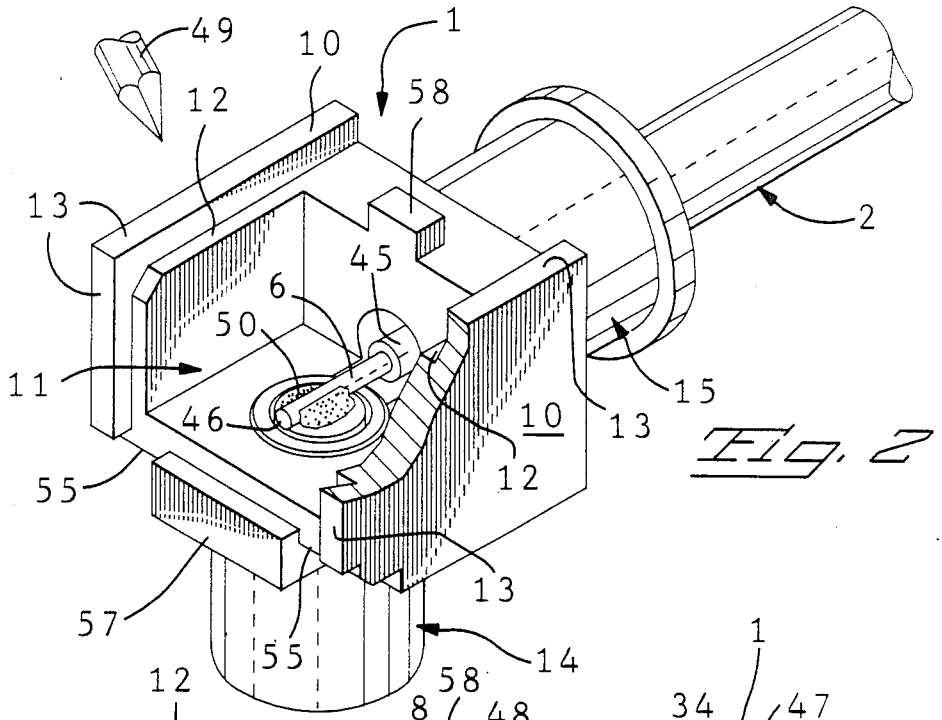
FIG. 2 is an enlarged perspective view of the connector shown in FIG. 1 with parts of the connector assembled and a solder connection between an electrical contact of the connector and a center conductor of the cable shown in FIG. 1.
Figure 4:
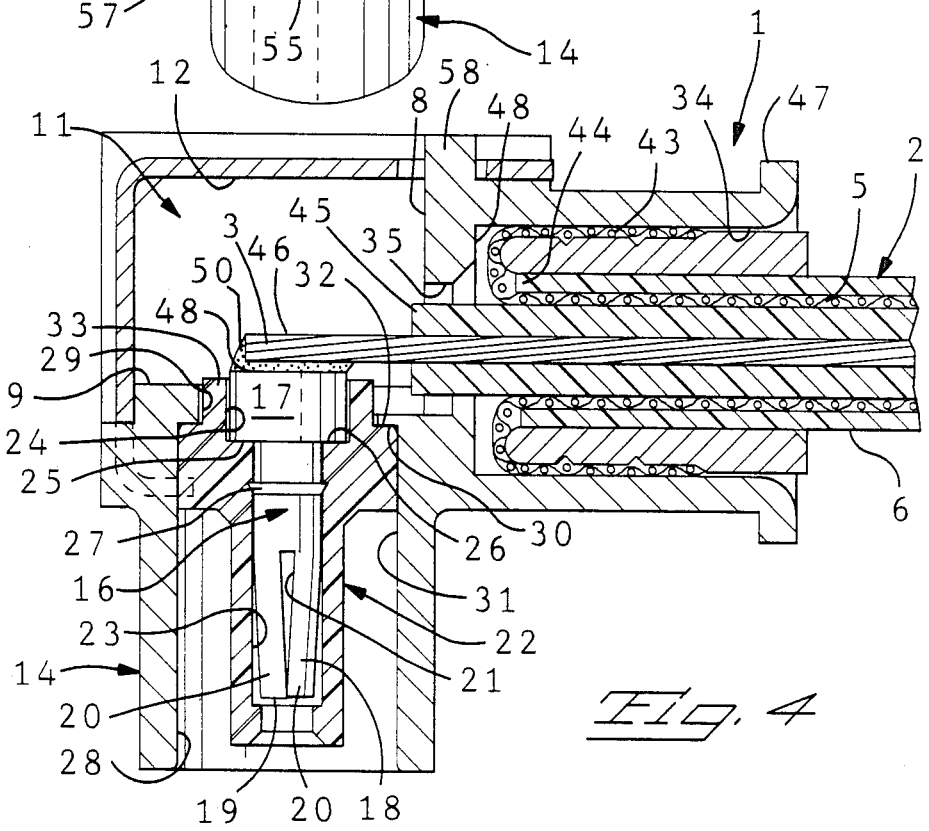
FIG. 4 is a side elevation view of an assembly of the parts shown in FIG. 3.

With more particular reference to FIGS. 1 and 4 there is shown an electrical connector 1 for a coaxial cable 2. The cable 2 includes a center conductor 3 concentrically encircled by an insulative layer 4 called a cable dielectric, in turn, concentrically encircled by a conductive sheath 5 constructed, for example, by multiple stands of wires woven or braided together, in turn, concentrically encircled by an insulative jacket 6.

A conductive shell 7 of the connector has intersecting sides 8,9 that bridge between opposite sides 10,10 and define a tool receiving cavity portion 11 open continuously toward two orthogonal directions, as shown at x and at y. The shell 7 includes cover engaging supports 12,12 in the form of ledges along the opposite sides 10,10 and recessed from the edges 13,13 of the opposite sides 11,11. The shell 7 includes a contact holder 14 and a cable holder 15 extending from the cavity portion 11. For example, the shell 7 can be fabricated by machining.

A conductive electrical contact 16 of the connector 1 is spaced from and concentrically encircled by the contact holder 14. The contact 16 includes an enlarged end portion 17 and an axially extending, reduced diameter, electrical receptacle portion 18. The receptacle portion 18 includes an open end 19 encircled by spring fingers 20,20 spaced apart from one another by axially extending slots 21.

An insulative body 22 of the connector is assembled with the contact 16. The insulative body 22 has an axial bore 23 receiving the receptacle portion 18 of the contact 16, and an enlarged counterbore 24 receiving the end portion 17 of the contact 16. The contact 16 has a shoulder 25 at an intersection of the end portion 17 and the receptacle portion 18. The shoulder 25 is engaged and seated against a wall 26 at an intersection of the counterbore 24 and the bore 23. The receptacle portion 18 includes an external encircling barb 27 inclined axially toward the end portion 17 and imbedded in the insulative body 22.

The insulative body 22 and the contact 16 are assembled with the contact holder 14. The contact holder 14 includes an axially extending stepped bore 28 having a smaller bore portion 29 communicating with the interior of the cavity portion 11. An internal encircling wall 30 of the contact holder 14 is at an intersection of a larger bore portion 31 and the smaller bore portion 29.

The insulative body 22 has an external encircling shoulder 32 engaged and seated against the wall 30. As shown in FIG. 4, the enlarged end portion 17 of the contact 16 projects into the interior of the cavity portion 11. An end 33 of the insulative body 22 projects into the interior of the cavity portion 11 and prevents electrical contact of the cavity portion 11 with the contact 16. The insulative body 22 concentrically encircles the end portion 17 of the contact 16, while the end portion 17 projects slightly from the insulative body 22. The end portion 17 of the contact 16 is positioned in the cavity portion 11 to receive and engage the center conductor 3 of coaxial cable 2 extended along the cable holder 15 and projecting into the cavity portion 11. The cable holder 15 of the connector 1 includes a stepped axial passage 34 having a reduced diameter portion 35 communicating with the interior of the cavity portion 11, and having an enlarged diameter portion 36 communicating with an outwardly flared end 37 of the cable holder 15 and with the reduced diameter portion 35.

Figure 3:
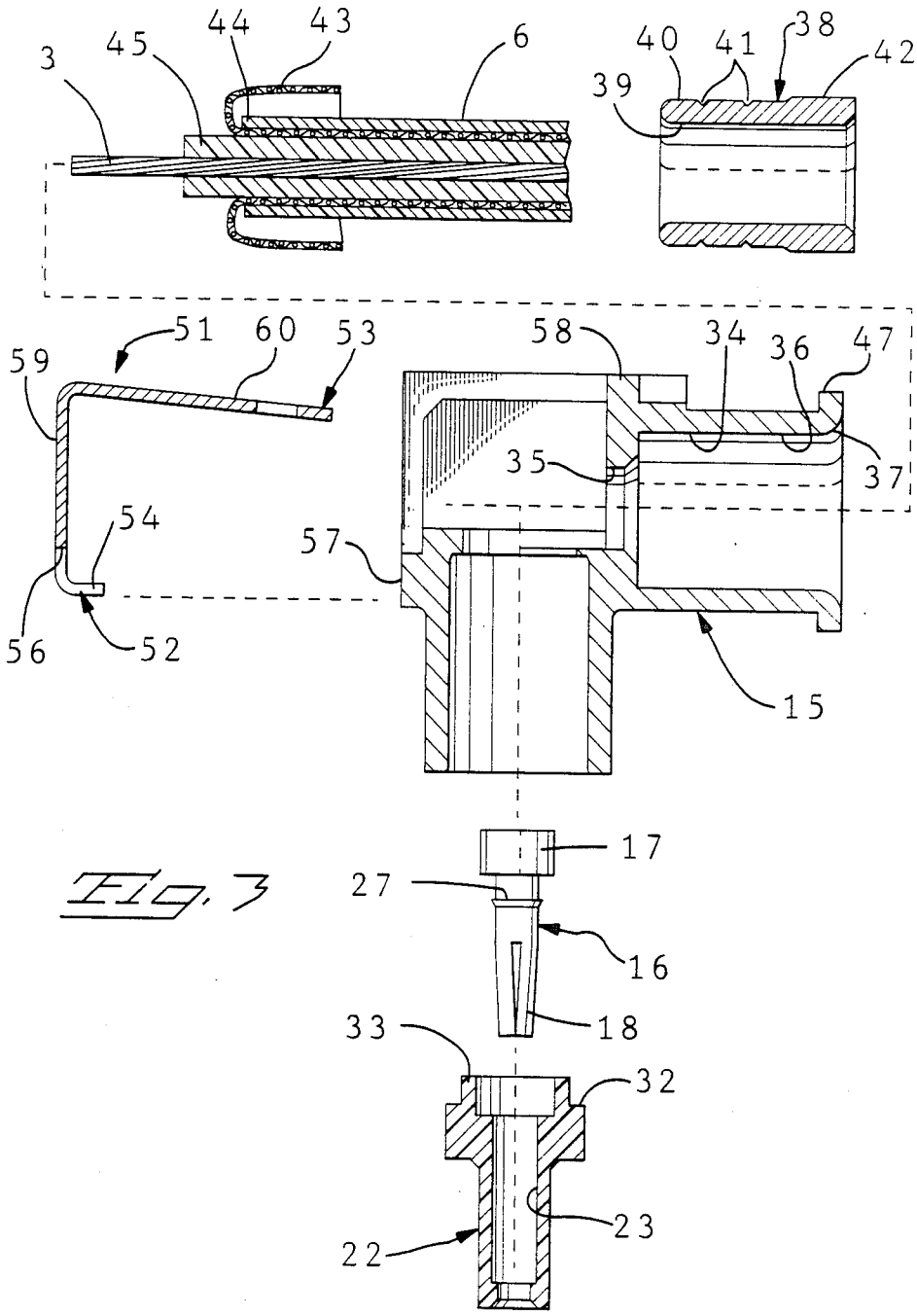
FIG. 3 is a side elevation view of the connector and the cable shown in FIG. 2, with parts exploded and with parts in section.

A conductive cylindrical ferrule 38 has an axial passage 39, a reduced diameter forward portion 40 provided with a series of exterior grooves 41,41 and an enlarged diameter end portion 42 having exterior knurling to facilitate manual manipulation. The ferrule 38 is assembled with the cable 2, with the cable 2 slidably received in the passage 39. As shown in FIGS. 3 and 4, a protruding portion 43 of the conductive sheath 5 protrudes from a cut end 44 of the insulative jacket 6 and is turned back on itself. The conductive sheath 5 is placed to surround the reduced diameter portion 40 of the ferrule. A protruding portion 45 of the insulative layer 4 protrudes from the cut end 44 of the cable jacket 6. A protruding portion 46 of the center conductor 3 protrudes from a cut end of the insulative layer portion 45. The ferrule 38 and cable 2 are assembled with the connector 1. The ferrule 38 and cable 2 are inserted into the passage 34 of the cable holder 15. An external flange 47 encircles the cable holder 15 and provides a means to hold and to restrain the holder 15 while the ferrule 38 and cable 2 are inserted axially along the passage 34. The ferrule 38 and conductive sheath 5 are assembled with a wedge fit within the cable holder 15. The sheath 5 is compressed between the ferrule 38 and the cable holder 15 to establish an electrical connection with the cable holder 15. The sheath 5 is forced into the series of grooves 41,41 to establish a firm grip of the sheath 5 by the cable holder 15 and the ferrule 38. The protruding portions 45,46 of the insulative layer 4 and the center conductor 3 project through the reduced diameter portion 35 of the passage 34 and into the interior of the cavity portion 11. An interior wall 48 of the cable holder 15 at the intersection of the enlarged diameter portion 36 and the reduced diameter portion 35 prevents the conductive sheath 5 from entering the interior of the cavity portion 11. The protruding portion 45 of the insulative layer 6 projects past the side 8 and prevents electrical engagement of the side 8 with the center conductor 3. The center conductor 3 overlaps the end portion 17 of the contact 16. The end portion 17 of the contact 16 is positioned in the cavity portion 11 and alongside the axis of the cable holder 15 and has a conductive solder receiving region 48. The open construction of the tool receiving cavity 11 provides access by a tool 49, for example, a tip of a soldering tool. The tool 49 applies heat and pressure to the portion 46 of the center conductor 3 and the end portion 17 of the contact 16 to melt a quantity of solder 50 that adheres on the solder region 48 of the end portion 17 of the contact 16. The solder 50 is applied on the solder region 48 either during the soldering operation or before assembly of the ferrule 38 and the cable 2 with the cable holder 15.

The connector 1 further includes an elongated conductive cover 51 fabricated from a strip of metal. Hooks 52,53 are provided at opposite ends of the cover 51. At one end the hook 52 is a pair of tabs 54,54 that overlap a corner edge 55 of the cavity portion 11. The tabs 54,54 are spaced apart and define a keyway 56. A projecting key 57 of the cavity portion 11 aligns with the keyway 56 and aligns the cover 51 during assembly. At the other end of the cover 51 the hook 53 is a hasp for registration with a projection 58 of the cavity portion 11. Assembly of the cover 51 is accomplished by hooking the tabs 54,54 on the corner edge 55 and moving the cover 51 to hook the hasp 53 on the projection 58. As shown in FIG. 3, the surfaces of supports 12,12 extend to a corner having a first angle. The cover 51 has first and second portions 59,60 that intersect each other at a second angle more acute than the first angle. With the cover 51 covering the cavity portion 11 of the shell 7, the supports 12,12 engage and resiliently deflect the cover 51 to a position bent along its length to conform to the surfaces of the supports 12,12. The hooks 52,53 engage the shell 7 and retain the cover 51 in a bent position and in engagement against the supports 12,12. The cover 51 retains stored spring energy to maintain pressure of the hooks 52,53 against the shell 7.

The connector 1 may be supplied as a kit of parts, with the ferrule 38 and the cover 51 separate from the shell 7, and with the contact 16 and insulative body 22 installed in the shell 7. The connector 1 as a kit of parts is readily assembled with a coaxial cable 2. The cavity portion 11 can be of relatively small size, and yet the open construction of the cavity portion 11 allows access to the interior of the connector 1. The cable holder 15 and the contact holder 14 project outwardly from the cavity portion 11, and can have diameters less than the width or height of the cavity portion 11.

We claim:

1. A connector for a coaxial cable, comprising;

a conductive shell having a tool receiving cavity portion open toward two orthogonal directions, a contact holder and a cable holder extending from the cavity portion, and cover engaging supports, a conductive electrical contact spaced from and concentrically encircled by the contact holder and having an end portion positioned in the cavity portion to receive and engage a center conductor of a coaxial cable extended along the cable holder and projecting into the cavity portion, an elongated conductive cover, hooks at opposite ends of the cover, the cover covers the cavity portion of the shell, the supports engage and resiliently deflect the cover to a position bent along its length, and the hooks engage the shell and retain the cover in a bent position and in engagement against the supports.

2. A connector as recited in claim 1, wherein, the cover supports extend along axes intersecting at a first angle, and the cover has first and second portions that intersect each other at a second angle more acute than the first angle.

3. A connector as recited in claim 1, wherein, the end portion of the electrical contact is a conductive solder receiving region.

4. A connector as recited in claim 1, wherein, the cavity portion of the shell extends between two sides of the shell.

5. A connector as recited in claim 1, wherein, the cover supports engage corresponding longitudinal edges of the cover.

6. A connector as recited in claim 4, wherein, the end portion of the contact is positioned in the cavity portion and alongside the axis of the cable holder 7. In a connector comprising, a conductive shell habing a tool receiving cavity, an electrical conductor within the shell, a cable holder extending from the cavity for receiving an electrical cable for connection to the shell and for connection within the interior of the shell to the electrical conductor and a cover for covering the cavity; the improvement comprising;

the conductive shell is constructed with opposite sides and additional sides that bridge between the opposite sides to define a tool receiving cavity open continously toward two orthogonal directions, and the cover has a length for covering the tool receiving cavity and extending along the two orthogonal directions.

8. In a connector as recited in claim 7, the improvement further comprising;

a portion of the electrical conductor within the tool receiving cavity is a conductive solder receiving region.

9. In a connector as recited in claim 7, the improvement further comprising; cover engaging supports along opposite sides of the shell to engage and resiliently deflect the cover along its length to retain the cover in a bent position in engagement against the supports and extended in the two orthogonal directions over the tool recieving cavity.

10. In a connector as recited in claim 9, the improvement further comprising;

the cover engaging supports extend along axes intersecting at a first angle, and the cover has first and second portions extending along the length of the cover and intersecting each other at a second angle more acute than the first angle.

* * * * *